United States Patent [19]

Dielman

[11] 4,048,775

[45] Sept. 20, 1977

[54] ANCHOR ASSEMBLY FOR PILASTERS

[75] Inventor: Harold J. Dielman, Cleveland, Ohio

[73] Assignee: The Sanymetal Products Co., Inc., Cleveland, Ohio

[21] Appl. No.: 624,588

[22] Filed: Oct. 22, 1975

[51] Int. Cl.[2] ..... E04H 1/00; E02D 27/00

[52] U.S. Cl. ..... 52/239; 52/296; 52/127

[58] Field of Search ..... 52/239, 70, 243, 585, 52/35, 39, 241, 240, 624; 287/20, 92

[56] References Cited

U.S. PATENT DOCUMENTS

| | | | |
|---|---|---|---|
| 2,175,717 | 10/1939 | Kerr | 52/239 |
| 2,268,264 | 12/1941 | Nimick et al. | 52/239 |
| 2,287,079 | 6/1942 | Anderson | 52/239 |
| 3,104,737 | 9/1963 | Fork | 52/39 |
| 3,108,664 | 10/1963 | Vawter | 52/239 |
| 3,194,362 | 7/1965 | Wargo | 52/239 |
| 3,748,793 | 7/1973 | Retz | 52/241 |

*Primary Examiner*—Ernest R. Purser
*Assistant Examiner*—Robert C. Farber
*Attorney, Agent, or Firm*—Meyer, Tilberry & Body

[57] ABSTRACT

An improved anchoring means for attaching a pilaster to an existing structure comprises a footer bar which is secured by mounting means to the pilaster end. The footer bar is adjustably attached to stud bolts extending from an existing structure to which the pilaster is to be attached. A stablizer nut on the end of the stud bolts is tightened to act against a portion of the pilaster. The action of the stabilizer nut causes the mounting means for the footer bar to be placed in tension thereby increasing the stability of the mounting of the pilaster.

3 Claims, 4 Drawing Figures

ANCHOR ASSEMBLY FOR PILASTERS

This invention relates to an improved means for anchoring pilasters to an existing structure such as a floor, wall, or ceiling.

It is often necessary for large floor areas to be sectioned off into smaller divisions such as washroom compartments, toilet compartments, hospital compartments, or office spaces. Such division can be easily accomplished by the erection of one or more spaced pilasters or posts. Panels or doors may then be attached to the pilasters to divide off areas as needed. The pilasters may be anchored either to the floor or the ceiling or to both floor and ceiling and thereby provide an inexpensive means of sectioning a large floor area while also permitting changes in the sectioning to be easily made.

Since the pilasters and the walls connected to them are in the nature of a temporary structure, it is often the case that such structures are inherently less stable than a solid built-in wall. This is particularly true when a pilaster is attached only to the floor or only to the ceiling. Various types of anchoring devices have been used in an attempt to improve the stability of the mounting of pilasters, such as for instance, attaching a U-shaped saddle bracket to a hollow pilaster whereby the legs of the bracket are welded to the inside portions of the hollow pilaster and the intermediate web portion is bolted to the existing structure. Many variations of this U-bracket mounting means have been commonly used in the art, however, none has overcome the inherent instability of the mountings with such structures.

Pilasters may be constructed of any material common for such purpose such as plastic, metal or wood. The instability found in the prior art is particularly true with regard to solid pilasters made of plastic.

It is an object of this invention to provide improved stability to the mounting of pilasters.

It is a further object of this invention to provide a means whereby a tensional force is introduced into the mounting means which secure the pilaster end portion thereby increasing the stability of the mounting of said pilaster.

It is yet another object of this invention to provide a simple mounting means which can easily be used to improve the stability of pilaster anchorages by causing mounting means such as lag bolts which attach portions of the anchorage assembly to the pilaster to be placed in tension which will result in an increased stability for the entire anchor.

It is a still further object of this invention to provide improved stability to the mounting of plastic pilasters.

These and other objects of the invention are accomplished in the present invention by providing a pilaster end portion having an end surface which is stepped laterally to either side and preferably having a Z-shaped stabilizer pad which conforms to the surface of the stepped and non-stepped portions of the pilaster end and a footer bar which extends over the stepped areas of the pilaster which is attached to the non-stepped portion of the pilaster by mounting means such as lag bolts passing through the footer bar and the portion of the Z-shaped stabilizer pad which extends over the non-stepped portion of the pilaster end into the pilaster end.

Holes are provided in the footer bar for passing stud bolts, which are secured in the existing structure to which the pilaster is to be attached, through the footer bar and permitting them to extend into the space defined by the stepped area of the pilaster end portion.

The stud bolts should extend from the existing structure and be of an axial length which will permit them to extend into the stepped portion of the pilaster end and no further and to a depth which will permit a stabilizer nut to be secured on the end of the stud bolt and still coact with the surface of the stabilizer pad. Adjusting nuts and washers are provided on the stud bolts on both sides of the footer bar for positioning the pilaster vertically on the stud bolts. Finally, a stabilizer nut is provided at the end of stud bolts which may be turned to act against the stabilizer pad in the stepped end portion. It is understood that a stabilizer nut of any axial length may be employed which will reach the stabilizer pad when still properly secure on the stud bolt end. The footer bar is thus forced away from the end portion of the pilaster thereby tensioning the lag bolts which secure the footer bar to the pilaster. Such tensional force causes improved stability in the pilaster mounting.

Further objects and advantages of the invention will become apparent from the following description of the preferred embodiment as shown in the drawings in which.

Similar reference numbers are used for the same parts throughout the various drawings which are provided to show the preferred embodiment of the invention and not intended to be limiting thereof.

DETAILED DESCRIPTION OF THE INVENTION AND THE DRAWINGS

Figure 1:
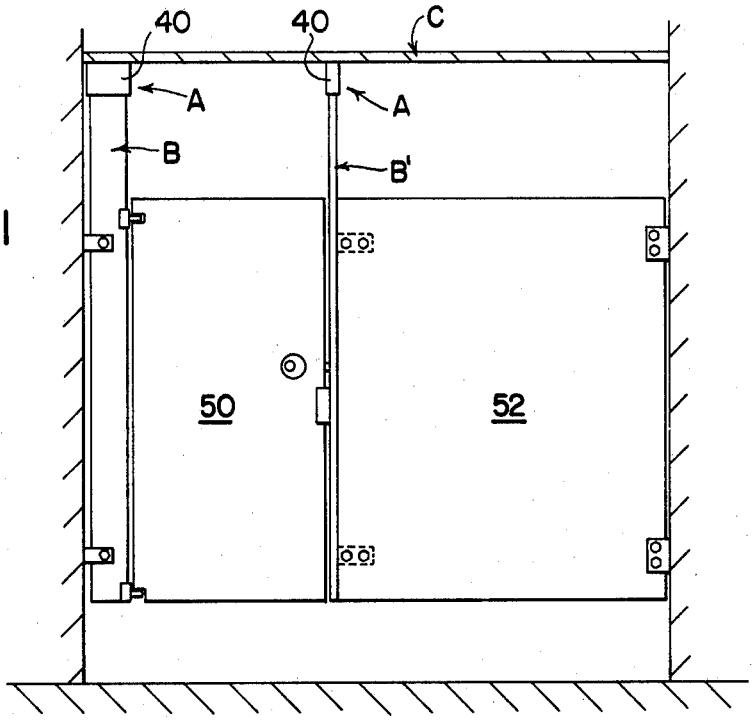
FIG. 1 is a front elevational view illustrating one environment in which the invention may typically be used.

In the drawings, the anchor assembly is indicated generally by A, the pilaster by B and the existing structure to which the pilaster is mounted by C.

A pilaster end portion 10 is provided with stepped portions 12 to either side of its central, non-stepped portion 14. Z-shaped stabilizer pads 20 are provided to conform to the stepped 12 and non-stepped 14 portions of the pilaster end 10. A footer bar 22 which is longer than the non-stepped portion 14 of the pilaster end 10 extends over the stepped portions 12 of the pilaster end 10. Lag bolts 24 extend through the footer bar 22 and the portions of the stabilizer pads 20 conforming to the non-stepped portion 14 of the pilaster end 10, and secure within the end portion of the pilaster. Stud bolt holes 26 are provided in the footer bar 22 in the area which extends over the stepped area 12 of the pilaster end 10 and through which the stud bolts 30 will pass.

Figure 2:
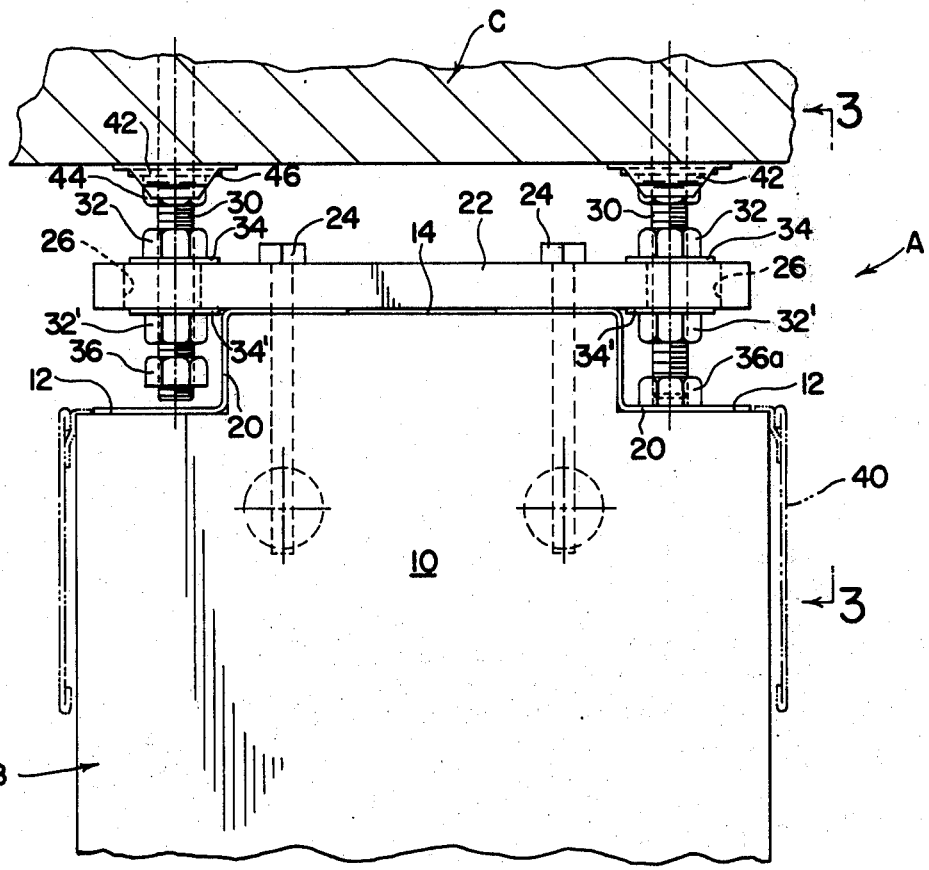
FIG. 2 is an enlarged side view in elevation of a pilaster end portion using the disclosed anchor assembly for mounting the pilaster to a ceiling structure.
Figure 3:
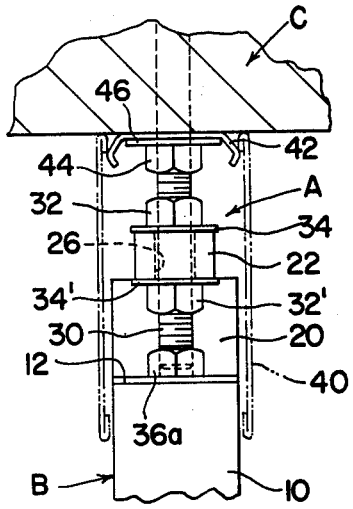
FIG. 3 is an enlarged edge view in elevation of the disclosed anchor assembly for a pilaster on its edge face indicated by arrows 3—3 of FIG. 2.

Stud bolts 30 extend from the existing floor, wall or ceiling structure C and pass through the stud bolt holes 26 provided in the footer bar 22. Adjustement nuts 32, 32' and washers 34, 34' are provided on the stud bolts 30 to adjustably act against both sides of the footer bar 22. Stabilizer nuts 36 and **36*a* are provided at the end of stud bolts 30. Stabilizer nut 36 is shown in the lefthand portion of the FIG. 2 in the mounting and height adjustment position and stabilizer nut 36*a* is shown in the righthand portion of FIG. 2 in final position in contact with the stabilizer pad 20 causing a force to be exerted against the stabilizer pad 20 thus pressing the footer bar 22 upward relative to the stabilizer pad 20 and tensioning the lag bolts 24 acting within the pilaster end portion 10. The pilaster may optionally be provided with a slideable shoe 40 which may be extended over the completed mounting assembly to conceal the assembly from view. FIG. 2 shows shoe 40 in phantom in the open position, while FIG. 3 shows the shoe 40 in phantom in installed position to conceal the entire mounting assembly A. Snap-on shoe clips 42 secured by clip nut 44 and washer 46 may also be provided on the stud bolts 30 to secure the shoe 40 in its final position after the assembly is completed such as shown in FIG. 3.**

FIG. 1 illustrates a typical installation in which the invention assembly may be employed. In the illustrated embodiment, pilasters B and B′ are secured to a ceiling structure C with shoes 40 in position to conceal the footer assembly. Pilaster B is mounted in a side facing position similar to that shown in the detail drawing of FIG. 2 while pilaster B′ is mounted in an edge facing position, similar to the detail shown in FIG. 3. FIG. 1 also illustrates door panel assembly 50 and wall panel 52 which may be attached to the mounted pilasters B and B′ in order to close off an area such as a restroom stall.

The improved anchor assembly is particularly useful in improving the stability of pilasters made of plastic but it to be understood that the invention is equally applicable to pilasters made of other materials such as wood or metal.

Figure 4:
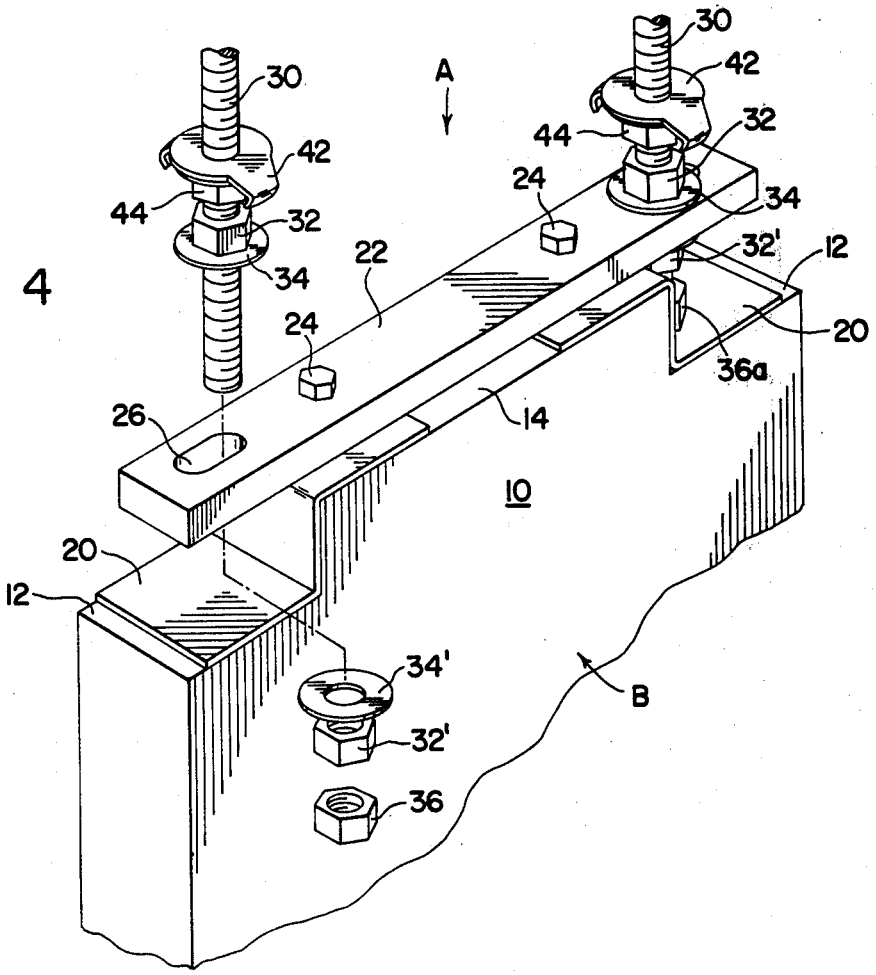
FIG. 4 is a view showing the method of attaching the anchor assembly and pilaster to an overhead structure.

The method of installation of the improved device may be shown in conjunction with FIG. 4.

To install a pilaster according to the present invention, stud bolts 30 are first rigidly located in the floor or ceiling structure to which the pilaster is to be attached. Optionally a shoe clip 42, clip retainer nut 44, and washer 46 and then an adjusting nut 32 and washer 34 are turned onto the stud bolt 30. Stud bolt 30 is then passed through the stud bolt hole 26 on footer bar 22, which is attached to the pilaster end portion 10 by mounting means such as lag bolts 24, after which another adjusting nut 32′ and washer 34′ along with stabilizer nut 36 are turned onto the stud bolt 30. The height of the pilaster is then adjusted using adjusting nuts 32, 32′ until the desired location is obtained. Finally, stabilizer nut 36 is turned to move outwardly toward the end of stud bolt 30 until stabilizer nut 36 contacts stabilizer pad 20 provided in the stepped portion 12 of pilaster end 10. Preferably, stabilizer nut 36 is then turned an additional one-half turn beyond the point of contact with stabilizer pad 20 in order to provide the force on the footer bar 22 which creates a tensional force in lag bolts 24. The stud bolt must be of a length sufficient to extend into the area above the stepped portion of the stabilizer pad to a distance less than the axial length of the stabilizer nut provided. Obviously, the stud bolt must not be of a length which is longer than the space provided in the stepped end portion.

The tensioning force on the lag bolts provided by the tightening of the stabilizer nut against the stabilizer pad provides for increased stability of the mounting of the pilaster overcoming the inherent instability of such mountings in the prior art.

What is claimed is:

1. A pilaster anchor for mounting a pilaster on stud bolts which extend from an existing structure and which have a remote end portion disposed away from said existing structure comprising a pilaster end surface having stepped portions and an intermediate non-stepped portion;

a footer bar on said non-stepped portion of said pilaster extending over said stepped portions of said pilaster and having stud bolt holes located therein;

mounting means for securing said footer bar to said non-stepped portion;

said stud bolts passing through said stud bolts holes on said footer bar and having:

a first pair of adjustment nuts on said stud bolts to bear against a first side of said footer bar and be opposite a second side of said footer bar, said second side being spaced from said stepper portions of said pilaster; a second pair of adjustment nuts on said stud bolts to bear against said second side of said footer bar, and a pair of stabilizer nuts on said remote end of said stud bolts, said stud bolts extending to regions adjacent said pilaster end surface on said stepped portions, whereby, when said stabilizer nuts are in pressure contact with said pilaster end surface, a thrust is applied against said pilaster end surface by said stabilizer nuts and against said second side of said footer bar by said second pair of adjustmant nuts while said first pair of adjustment nuts acts against said first side of said footer bar.

2. The pilaster anchor as described in claim 1 and further including stabilizer pads conforming to said stepped and non-stepped portions of said pilaster end portion and which are secured thereon by said mounting means, said stabilizer nut acting on said stabilizer pad within said stepped portion.

3. The pilaster anchor as described in claim 1 wherein said mounting means comprises at least one lag bolt extending into said pilaster end.

* * * * *